US007954649B1

(12) United States Patent
Froehlich

(10) Patent No.: US 7,954,649 B1
(45) Date of Patent: Jun. 7, 2011

(54) DRILL BIT HOLDING DEVICE

(76) Inventor: Glen A. Froehlich, Litchfield Park, AZ (US)

( * ) Notice: Subject to any disclaimer, the term of this patent is extended or adjusted under 35 U.S.C. 154(b) by 276 days.

(21) Appl. No.: 12/324,514

(22) Filed: Nov. 26, 2008

(51) Int. Cl.
*A47F 7/00* (2006.01)

(52) U.S. Cl. ..... 211/69; 211/70; 211/163

(58) Field of Classification Search ..... 211/69, 211/70.6, 163, 77, 78, 70; 248/218.4, 219.4, 248/230.5, 231.61; 81/490, 177.4; 206/234, 206/379; 108/152
See application file for complete search history.

(56) References Cited

U.S. PATENT DOCUMENTS 1,704,122 A * 3/1929 Cohen ..... 206/368
3,063,568 A * 11/1962 Ladenheim et al. ..... 211/77
3,489,289 A * 1/1970 Scott-Fenton ..... 211/78
3,620,174 A * 11/1971 Dentino ..... 108/151
3,966,052 A * 6/1976 Knaus ..... 211/70.6
4,311,101 A * 1/1982 de Almagro ..... 108/152
D281,835 S 12/1985 Ali
4,932,294 A 6/1990 Chang
4,973,205 A 11/1990 Spaulding
5,098,235 A 3/1992 Svetlik et al.
D354,989 S * 1/1995 West ..... D19/85
5,379,885 A * 1/1995 Chen ..... 206/216
5,597,275 A 1/1997 Hogan
5,931,061 A 8/1999 Kuo
6,334,743 B1 1/2002 Liao

* cited by examiner

*Primary Examiner* — Korie H. Chan

(57) ABSTRACT

A drill bit holding device for holding drill bits and attaching to a column of a drill press comprising a base attachable to the drill press column, a rotating plate rotatably attached to the base via a bolt assembly, and a removable drill bit holder having a plurality of drill bit holes for holding drill bits disposed atop the rotating plate.

3 Claims, 5 Drawing Sheets

DRILL BIT HOLDING DEVICE

FIELD OF THE INVENTION

The present invention is directed to a storage device for storing drill bits. More particularly, the present invention is directed to a storage device for storing drill bits that can be attached to a drill press.

BACKGROUND OF THE INVENTION

A variety of types and sizes of bits can be used with a drill press. If a user wishes to change the bit, he/she must search for the bit in his/her workshop or other area. This is often inconvenient and time consuming.

The present invention features a drill bit holding device for storing drill bits. The drill bit holding device may be attached to any standard drill press. The device eliminates the need for a user to search for additional bits for his/her drill.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
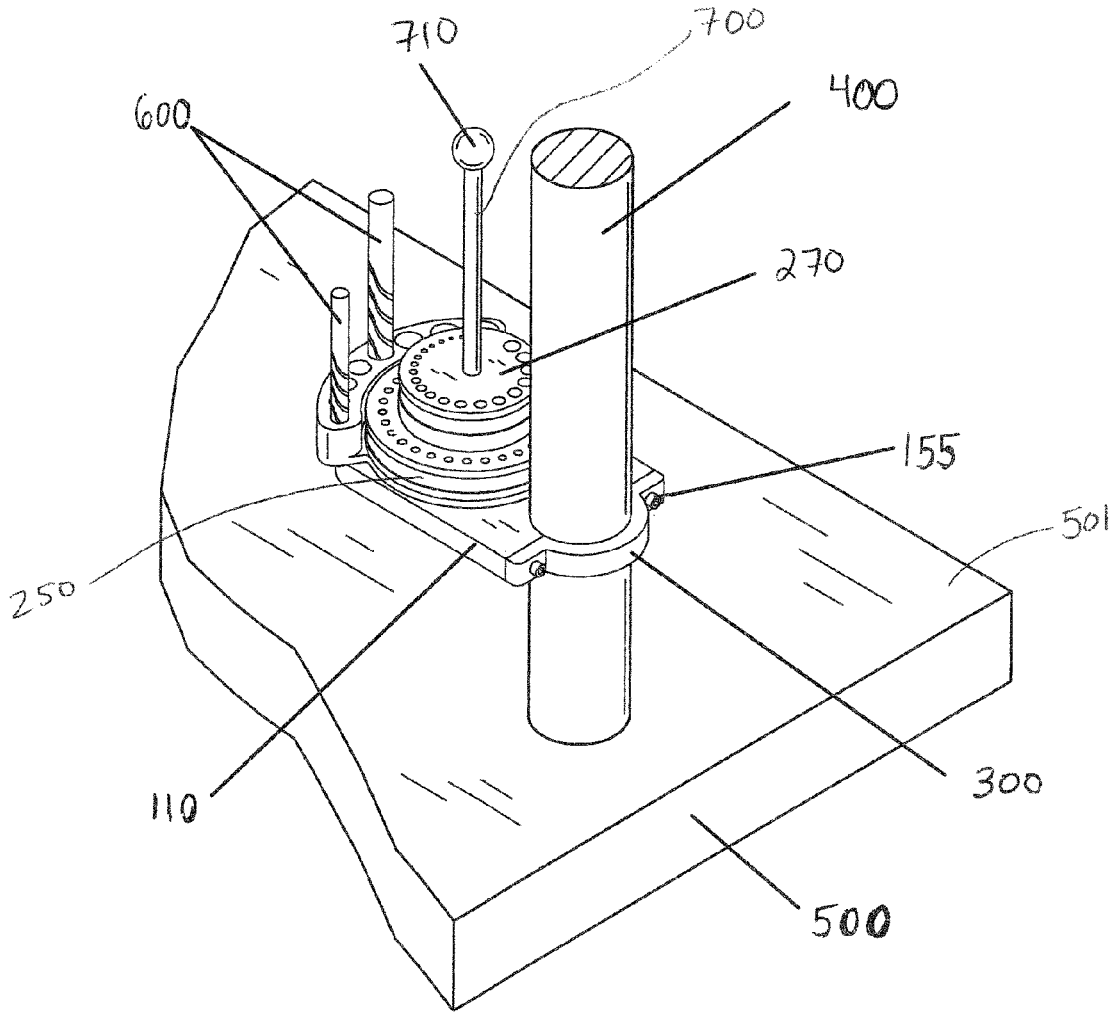
FIG. 1 is a perspective view of the drill bit holding device of the present invention.
Figure 2:
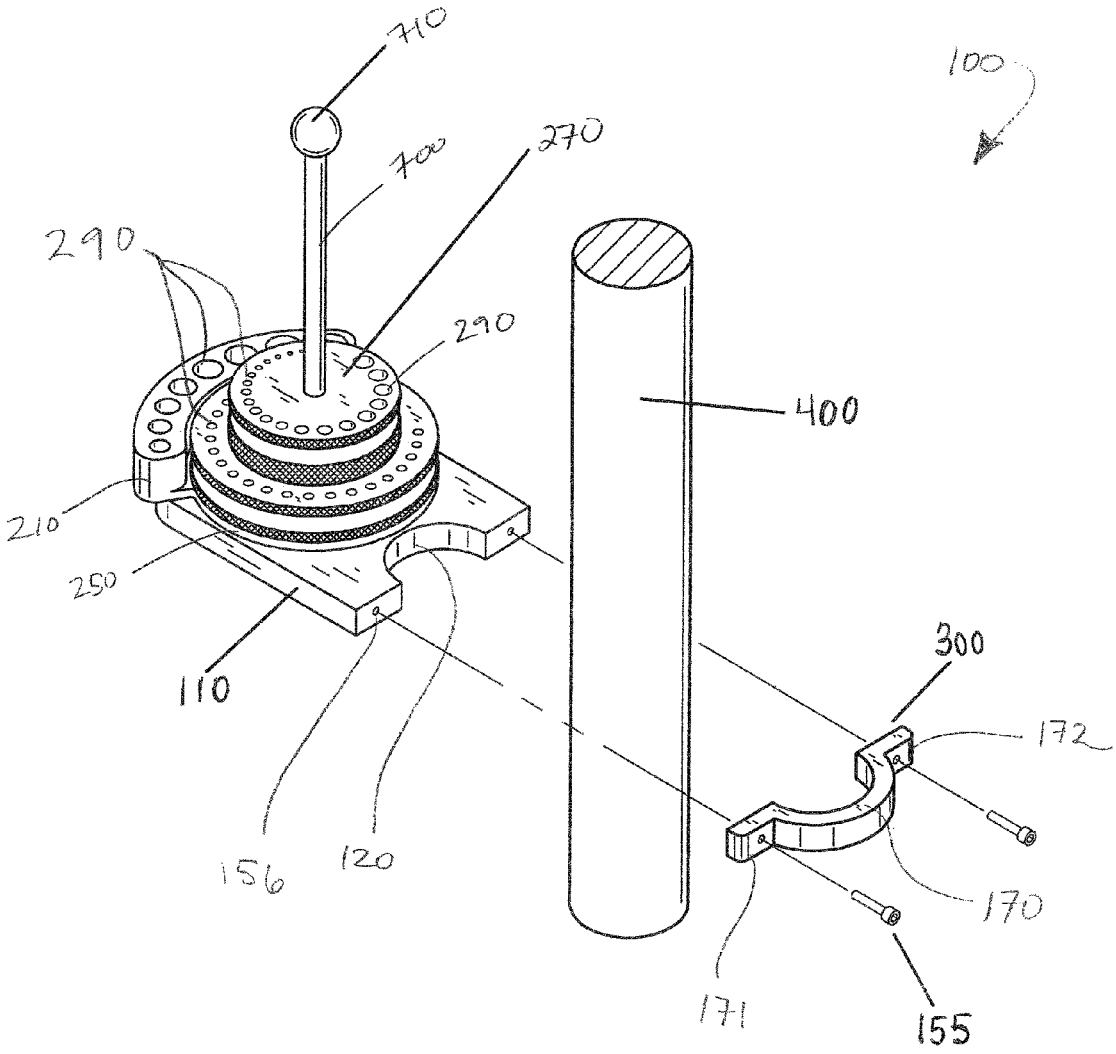
FIG. 2 is a perspective view of the drill bit holding device of the present invention.
Figure 3:
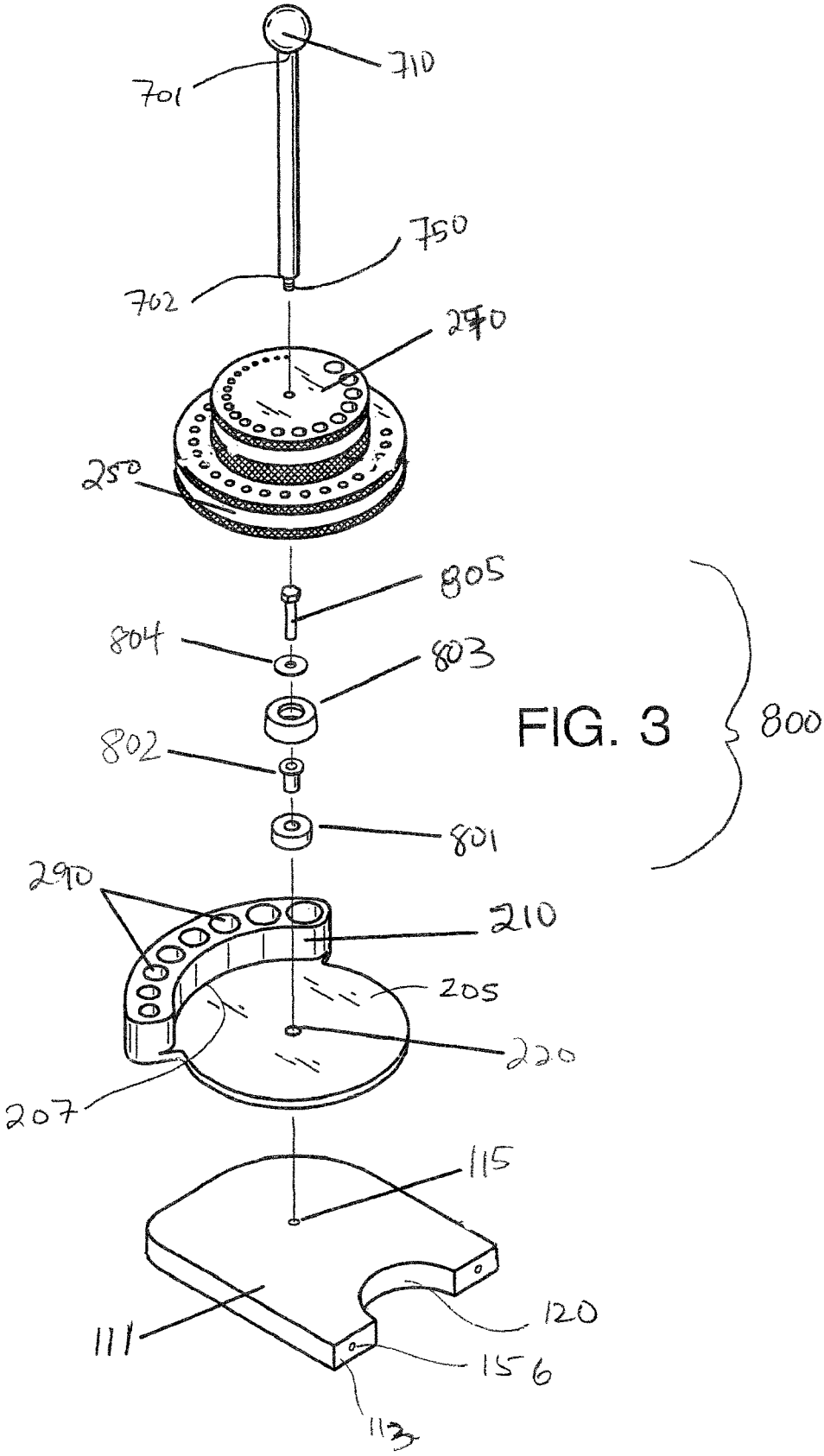
FIG. 3 is an exploded view of the components of the drill bit holding device of the present invention.
Figure 4:
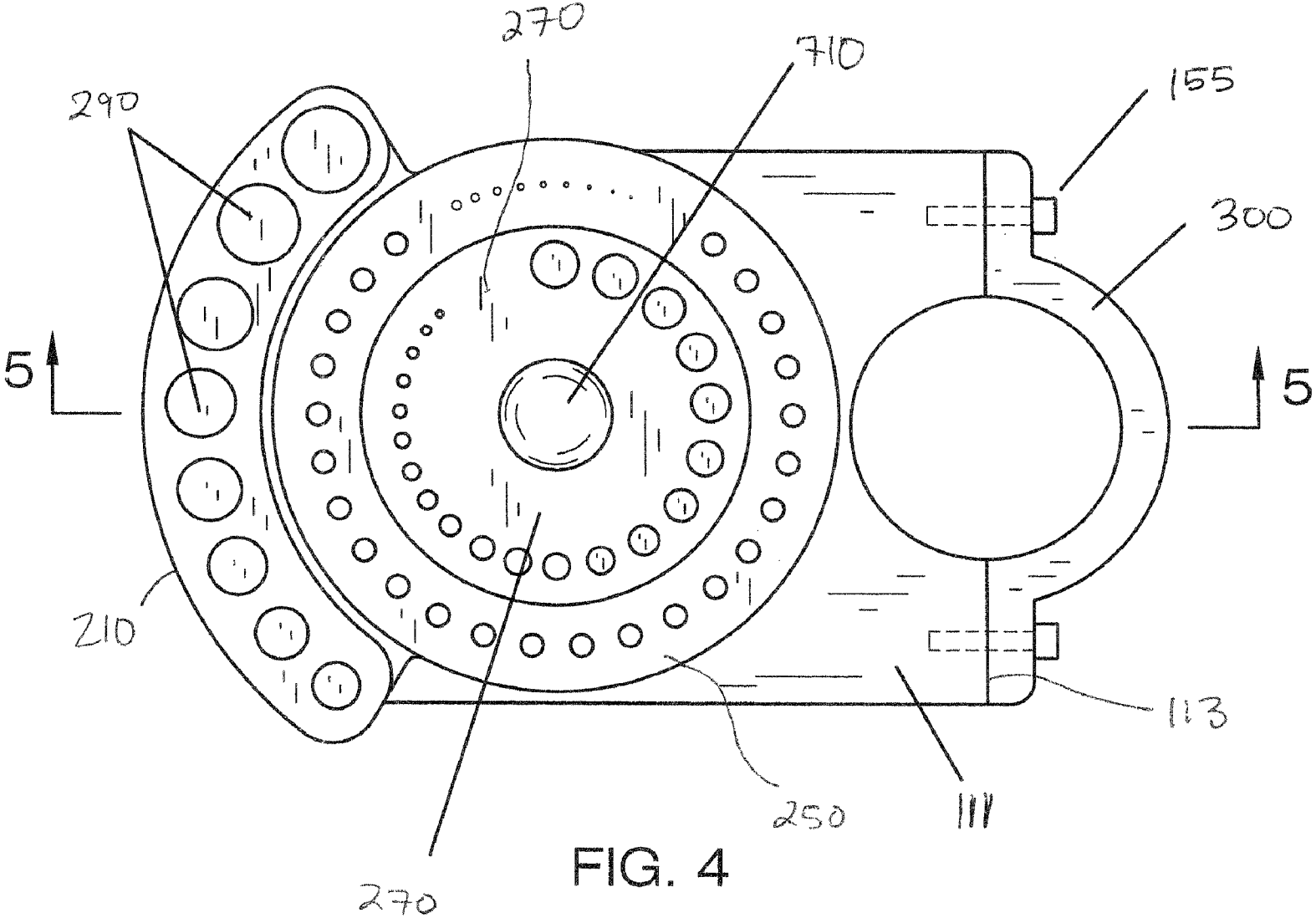
FIG. 4 is a top view of the drill bit holding device of the present invention.
Figure 5:
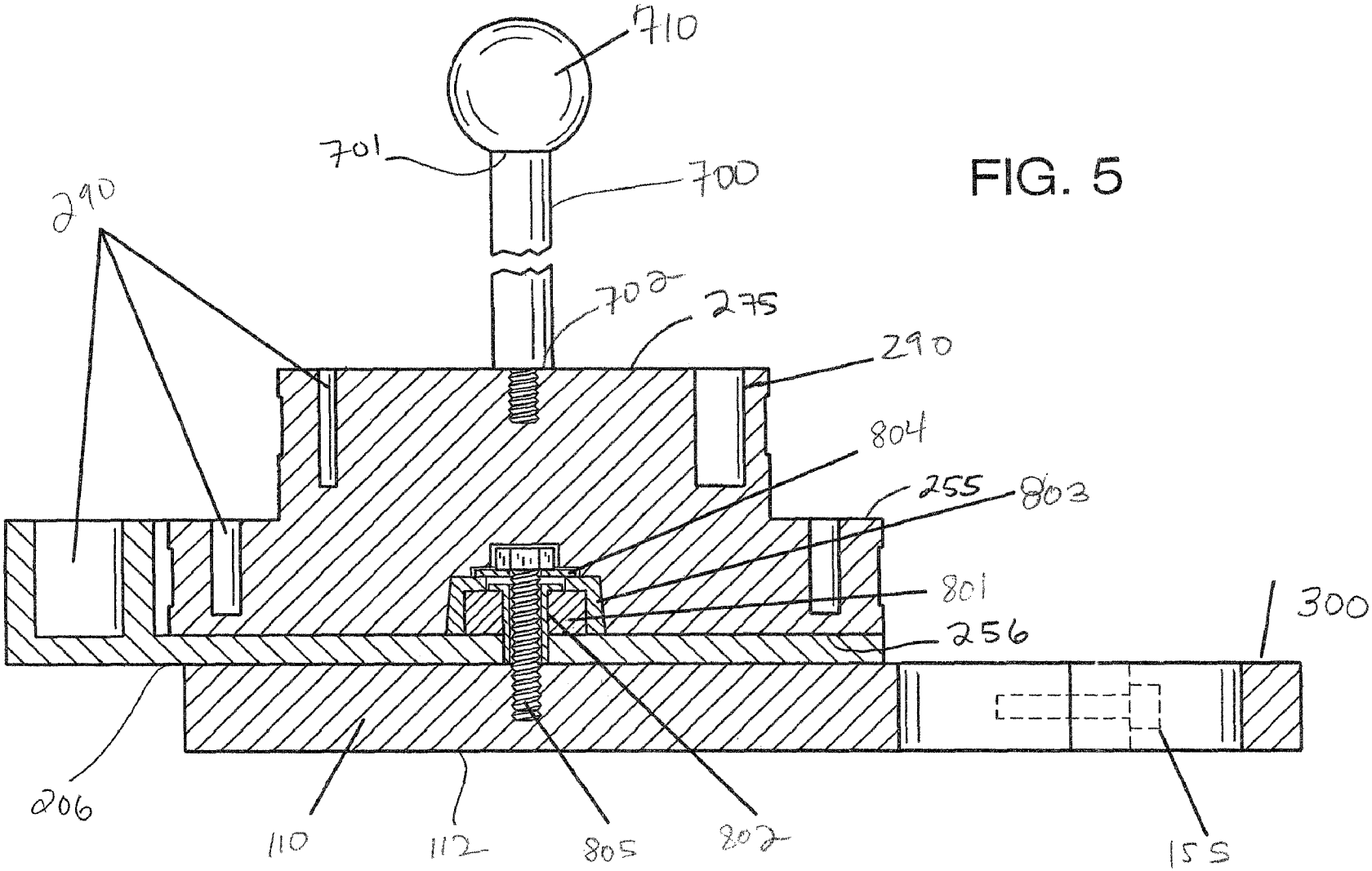
FIG. 5 is a side view and cross sectional view of the drill bit holding device of the present invention.

Referring now to FIGS. 1-5, the present invention features a drill bit holding device 100 for attaching to a drill press. In some embodiments, the drill press is attached to a column 400. In some embodiments, the column 400 is attached to a table 500 (e.g., on the top surface 510) or other surface. In some embodiments, the column 400 is a cylinder having an outside surface, a top edge, a bottom edge, and a middle portion.

The drill bit holding device 100 of the present invention comprises a base 110 having a top surface 111, a bottom surface 112, a first edge 113, a second edge 114, a third edge, a fourth edge, and a threaded center hole 115. In the middle of first edge 113 is a semicircular indentation 120 between a first screw aperture 156 and a second screw aperture 156. The semicircular indentation 120 is for connecting to (e.g., wrapping around) the outer surface of the middle portion of the column. The screw apertures 156 are for receiving screws 155 or other similar attachment devices.

A clamp component 300 is used to attach the base to the column 400 of the drill press. The clamp component 300 comprises a semicircular bar 170 having a first and a second end, wherein a first wing 171 having a third screw aperture 156 is attached to the first end and a second wing 172 having a fourth screw aperture 156 is attached to the second end. The semicircular bar 170 is for connecting to (e.g., wrapping around) the outer surface of the middle portion of the column 400 by aligning the first screw aperture 156 of the base 110 with the third screw aperture 156 of the clamp component 300, and the second screw aperture 156 of the base 110 with the fourth screw aperture 156 of the clamp component 300. Screws 155 or other similar attachment devices may be inserted through the screw apertures 156 to connect the clamp component 300 to the base 110. Together the first edge 113 of the base 110 and the clamp component 300 clamp the outside surface of the column 400 of the drill press. This arrangement allows the drill bit holding device 100 to be slipped around the column 400 of any standard drill press and be connected together with screws 155 or the like.

Disposed on the top surface 111 of the base 110 is a rotator plate 200. The rotator plate 200 has a top surface 205, a bottom surface 206, a center hole 220, and an outer edge 207. Disposed on the outer edge 207 is a side arm 210 for holding drill bits 600 (e.g., large diameter drill bits). In some embodiments, the side arm 220 wraps around a portion of the outer edge 207 of the rotator plate 200.

The rotator plate 200 is attached to the top surface 111 of the base 110 via a bolt assembly 800 such that the rotator plate 200 can spin freely. The bolt assembly 800 comprises a bearing 801, a bushing 802, an alum taper fit 803, a washer 804, and a threaded bolt 805. The center hole 220 of the rotator plate 200 is aligned with the threaded center hole 115 of the base 110. The bearing 801 is aligned with the center hole 220 of the rotator plate 200. The hollow bushing 802 can be inserted through the bearing 801 and the center hole 220 of the rotator plate 200. In some embodiments, an alum taper fit 803 is placed over the bushing 802 and bearing 801. The washer 804 is aligned with the holes of the alum taper fit 803, the bushing 802, and the bearing 801. A threaded bolt 805 can be inserted through the washer 804, alum taper fit 803, bushing 802, bearing 801, the center hole of the rotator plate 220, and can be screwed into the threaded center hole 115 of the base 110. The bolt assembly 800 allows the rotator plate 200 to spin freely about the axis of the threaded bolt 805.

The drill bit holding device 100 of the present invention further comprises a removable drill bit holder. The removable drill bit holder can be removably attached to the top surface 205 of the rotator plate 200. The removable drill bit holder has a first bit holder 250 having a top surface 255 and a bottom surface 256, and a second bit holder 270 having a top surface 275 and a bottom surface attached to the top surface 255 of the first bit holder 250. In some embodiments, the second bit holder 270 has a diameter that is smaller than the diameter of the first bit holder 250.

Disposed in the center of the bottom surface 256 of the first bit holder 250 is an indentation for receiving the bolt assembly 800 of the rotator plate 200. In some embodiments, the first bit holder 250 is placed on the rotator plate 200 by inserting the bolt assembly 800 of the rotator plate 200 into the indentation disposed on the bottom surface 256 of the first bit holder 250.

Disposed on the top surface 255 of the first bit holder 250 and/or the second bit 270 holder a plurality of drill bit holes 290 for holding drill bits 600. In some embodiments, the plurality of drill bit holes 290 includes a variety of diameters. In some embodiments, one or more drill bit holes 290 can be labeled to identify the diameter of the bit 600 that would fit in the drill bit hole 290.

A rotating component 700 can be used to spin the first bit holder 250, second bit holder 270, and rotator plate 200. In some embodiments, the rotating component 700 has a first end 701 and a second end 702. A knob 710 is disposed at the first end 701, and a rotating component screw 750 is disposed at the second end 702. The threaded portion of the rotating component screw 750 protrudes outward from the second end 702. The rotating component screw 750 is for screwing into a center hole on the top surface 275 of the second bit plate 270. The bit plates and rotator plates can be spun by turning the knob 710 in a counterclockwise or clockwise direction.

The drill bit holding device 100 of the present invention may be constructed from a variety of materials. For example, in some embodiments, the drill bit holding device 100 is constructed from a material comprising a metal (e.g., aluminum), a plastic, a wood, the like, or a combination thereof.

As used herein, the term "about" refers to plus or minus 10% of the referenced number. For example, an embodiment wherein the base is about 10 inches in length includes a base that is between 9 and 11 inches in length.

The drill bit holding device 100 of the present invention may be constructed in variety of sizes. For example, in some embodiments, the first bit holder 250 is between about 4 to 6 inches in diameter. In some embodiments, the first bit holder 250 is between about 6 to 8 inches in diameter. In some embodiments, the first bit holder 250 is between about 8 to 10 inches in diameter. In some embodiments, the first bit holder 250 is between about 10 to 12 inches in diameter. In some embodiments, the first bit holder 250 is more than about 12 inches in diameter.

In some embodiments, the second bit holder 270 is between about 3 to 4 inches in diameter. In some embodiments, the second bit holder 270 is between about 4 to 6 inches in diameter. In some embodiments, the second bit holder 270 is between about 6 to 8 inches in diameter. In some embodiments, the second bit holder 270 is between about 8 to 10 inches in diameter. In some embodiments, the second bit holder 270 is between about 10 to 12 inches in diameter. In some embodiments, the second bit holder 270 is more than about 12 inches in diameter.

In some embodiments, the base 110 is between about 8 to 10 inches in length as measured from the first edge to the second edge. In some embodiments, the base 110 is between about 10 to 12 inches in length as measured from the first edge to the second edge. In some embodiments, the base 110 is between about 12 to 16 inches in length as measured from the first edge to the second edge. In some embodiments, the base 110 is more than about 16 inches in length.

In some embodiments, the base 110 is between about 8 to 10 inches in width as measured from the third edge to the fourth edge. In some embodiments, the base 110 is between about 10 to 12 inches in width as measured from the third edge to the fourth edge. In some embodiments, the base 110 is between about 12 to 16 inches in width as measured from the third edge to the fourth edge. In some embodiments, the base 110 is more than about 16 inches in width.

In some embodiments, the base 110 is between about 1 to 2 inches in depth as measured from the top surface to the bottom surface. In some embodiments, the base 110 is between about 2 to 3 inches in depth as measured from the top surface to the bottom surface. In some embodiments, the base 110 is between about 3 to 4 inches in depth as measured from the top surface to the bottom surface. In some embodiments, the base 110 is more than about 4 inches in length.

The following the disclosures of the following U.S. Patents are incorporated in their entirety by reference herein: U.S. Pat. No. 5,931,061; U.S. Pat. No. 5,597,275; U.S. Pat. No. 6,334,743 B1; U.S. Pat. No. 4,932,294; U.S. Pat. No. 4,973,205; U.S. Pat. No. 5,098,235

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A base having a top surface, a bottom surface, a first edge, a second edge, and a threaded center hole;

(a) semicircular indentation disposed on the first edge of the base between a first screw aperture and a second screw aperture; wherein the first screw aperture and second screw aperture are both for receiving screws; wherein the semicircular indentation is for wrapping around the column;

(b) a clamp component for attaching the base to the column, said clamp component comprising a semicircular bar having a first end and a second end; wherein a first wing having a third screw aperture is attached to the first end and a second wing having a fourth screw aperture is attached to the second end; said third screw aperture and fourth screw aperture are for receiving screws; wherein the base is secured to the column by inserting a screw in the first screw aperture of the base and third screw aperture of the clamp component simultaneously and by inserting a screw in the second screw aperture of the base and fourth screw aperture of the clamp component simultaneously;

(c) a rotator plate having a to surface, a bottom surface a center hole and an outer edge comprising a side arm for holding drill bits; wherein the rotator plate is attached to the top surface of the base via a bolt assembly such that the rotator plate can spin freely; and (d) a removable drill bit holder rotatably attached to the top surface of the rotator plate atop the bolt assembly, wherein the drill bit holder comprises a plurality of drill bit holes for holding drill bits; wherein the bolt assembly comprises a bearing, a bushing, an alum taper fit, a washer, and a threaded bolt; wherein the center hole of the rotator plate is aligned with the threaded center hole of the base, the bearing is aligned with the center hole of the rotator plate, and the bushing is inserted through the bearing and the center hole of the rotator plate.

2. A base having a top surface, a bottom surface, a first edge, a second edge, and a threaded center hole;

(a) a semicircular indentation disposed on the first edge of the base between a first screw aperture and a second screw aperture; wherein the first screw aperture and second screw aperture are both for receiving screws; wherein the semicircular indentation is for wrapping around the column;

(b) a clamp component for attaching the base to the column, said clamp component comprising a semicircular bar having a first end and a second end; wherein a first wing having a third screw aperture is attached to the first end and a second wing having a fourth screw aperture is attached to the second end; said third screw aperture and fourth screw aperture are for receiving screws; wherein the base is secured to the column by inserting a screw in the first screw aperture of the base and third screw aperture of the clamp component simultaneously and by inserting a screw in the second screw aperture of the base and fourth screw aperture of the clamp component simultaneously;

(c) a rotator plate having a top surface, a bottom surface, a center hole, and an outer edge comprising a side arm for holding drill bits; wherein the rotator plate is attached to the top surface of the base via a bolt assembly such that the rotator plate can spin freely; and (d) a removable drill bit holder rotatably attached to the top surface of the rotator plate atop the bolt assembly, wherein the drill bit holder comprises a plurality of drill bit holes for holding drill bits;

wherein the alum taper fit is placed over the bushing and bearing; the washer is aligned with the alum taper fit, the bushing, and the bearing; a threaded bolt is inserted through the washer, alum taper fit, bushing, bearing, and the center hole of the rotator plate; and the threaded bolt is screwed into the threaded center hole of the base.

3. A base having a top surface, a bottom surface, a first edge, a second edge, and a threaded center hole;

a) a semicircular indentation disposed on the first edge of the base between a first screw aperture and a second screw aperture; wherein the first screw aperture and second screw aperture are both for receiving screws; wherein the semicircular indentation is for wrapping around the column;

(b) a clamp component for attaching the base to the column, said clamp component comprising a semicircular bar having a first end and a second end; wherein a first wing having a third screw aperture is attached to the first end and a second wing having a fourth screw aperture is attached to the second end; said third screw aperture and fourth screw aperture are for receiving screws; wherein the base is secured to the column by inserting a screw in the first screw aperture of the base and third screw aperture of the clamp component simultaneously and by inserting a screw in the second screw aperture of the base and fourth screw aperture of the clamp component simultaneously;

(c) a rotator plate having a top surface, a bottom surface, a center hole, and an outer edge comprising a side arm for holding drill bits; wherein the rotator plate is attached to the top surface of the base via a bolt assembly such that the rotator plate can spin freely; and (d) a removable drill bit holder rotatably attached to the top surface of the rotator plate atop the bolt assembly, wherein the drill bit holder comprises a plurality of drill bit holes for holding drill bits;

wherein the removable drill bit holder comprises a first bit holder and a second bit holder atop the first bit holder.

* * * * *